US010544629B2

(12) United States Patent
Farrar et al.

(10) Patent No.: US 10,544,629 B2
(45) Date of Patent: Jan. 28, 2020

(54) DEBRIS MANAGEMENT ASSEMBLY

(71) Applicants: Benjamin Farrar, Cypress, TX (US); James Smith, Manvel, TX (US)

(72) Inventors: Benjamin Farrar, Cypress, TX (US); James Smith, Manvel, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 15/978,970

(22) Filed: May 14, 2018

(65) Prior Publication Data

US 2019/0345776 A1 Nov. 14, 2019

(51) Int. Cl.
*E21B 17/00* (2006.01)
*E21B 34/12* (2006.01)

(52) U.S. Cl.
CPC ..... *E21B 17/006* (2013.01); *E21B 34/12* (2013.01)

(58) Field of Classification Search
CPC ..... E21B 17/006; E21B 27/00; E21B 34/12; E21B 41/0021
See application file for complete search history.

(56) References Cited

U.S. PATENT DOCUMENTS 2,819,038 A * 1/1958 Eckel ..... E21B 4/18 175/100
2,894,725 A * 7/1959 Baker ..... E21B 27/005 166/99
4,857,175 A * 8/1989 Spinnler ..... B01D 29/115 209/235
5,108,272 A * 4/1992 Brewer ..... F04B 47/02 417/520
5,176,208 A * 1/1993 Lalande ..... E21B 27/005 166/162
6,276,452 B1 * 8/2001 Davis ..... E21B 21/002 166/107
7,753,113 B1 * 7/2010 Penisson ..... E21B 27/00 166/162
8,162,064 B1 * 4/2012 Penisson ..... E21B 27/00 166/335
8,540,028 B1 * 9/2013 Penisson ..... E21B 27/00 166/335
8,746,340 B2 * 6/2014 Mashburn ..... E21B 31/00 166/301
9,441,435 B2 * 9/2016 Leitch ..... E21B 27/005
2002/0053428 A1 * 5/2002 Maples ..... E21B 27/00 166/99
2009/0200012 A1 * 8/2009 Davis ..... E21B 27/005 166/99
2012/0152522 A1 * 6/2012 Lynde ..... E21B 37/10 166/99

* cited by examiner

*Primary Examiner* — Matthew R Buck
(74) *Attorney, Agent, or Firm* — Cantor Colburn LLP

(57) ABSTRACT

A debris management assembly including a housing, a mandrel disposed within the housing, a debris sump defined between the mandrel and the housing, and a debris diverter operably connected to the mandrel and positioned to direct debris that encounters the debris diverter into the debris sump.

14 Claims, 2 Drawing Sheets

DEBRIS MANAGEMENT ASSEMBLY

BACKGROUND

In the resource recovery industry and particularly the hydrocarbon recovery aspect thereof, boreholes in hydrocarbon bearing formations are often drilled and developed with strings of tools that have a myriad of purposes. Some operations require isolation valves to close off a zone downhole of one in which some other operation is being undertaken. Such isolation valves are commonly used but suffer from the accumulation of debris that can in some circumstances hinder actuation of such valves and require additional cleanout operations in order for an operator to move to a next phase of a process being undertaken. Since additional operations are costly and cause delay they are undesirable and to be avoided. Accordingly, the art would well receive apparatus that protects isolation valves from debris that operate reliably without issues related to debris.

SUMMARY

A debris management assembly including a housing, a mandrel disposed within the housing, a debris sump defined between the mandrel and the housing, and a debris diverter operably connected to the mandrel and positioned to direct debris that encounters the debris diverter into the debris sump.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
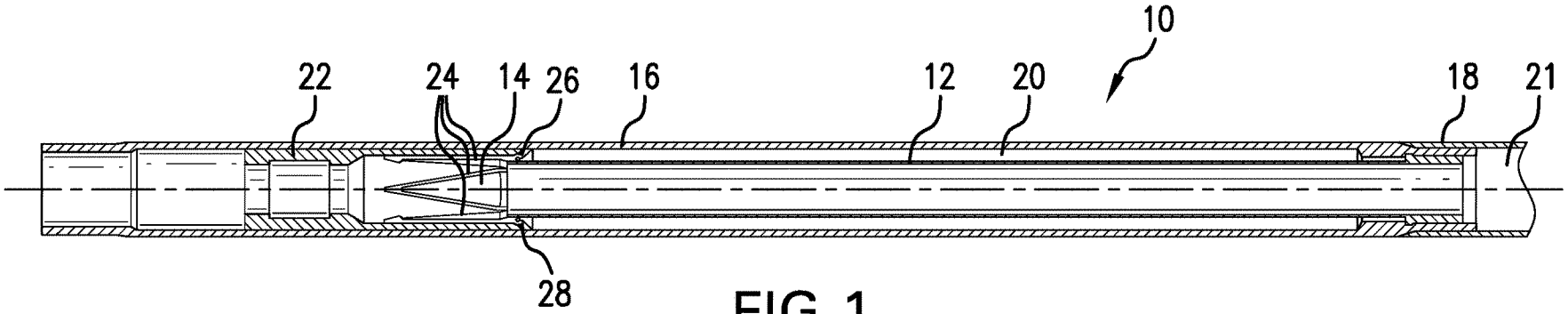
FIG. 1 is a cross sectional view of a debris management assembly in a closed position.
Figure 2:
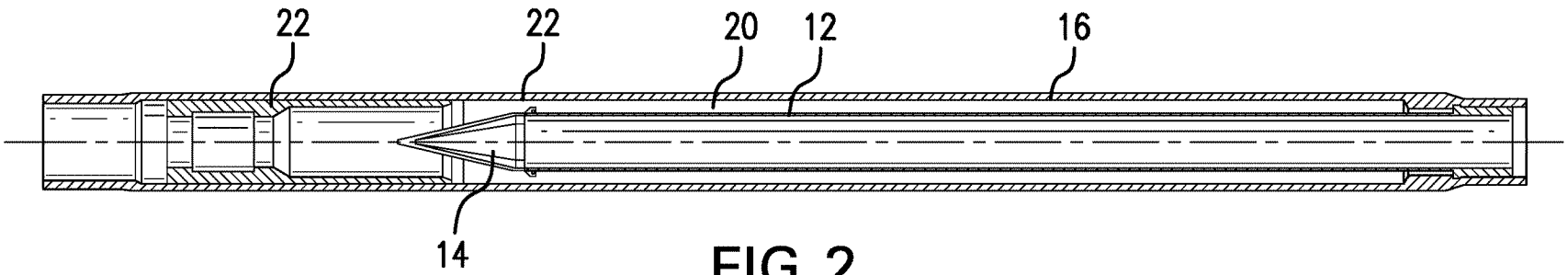
FIG. 2 is a cross sectional view of a debris management assembly in an open position.

Referring to FIGS. 1 and 2, a debris management assembly 10 is illustrated in an open position and a closed position, respectively. The assembly 10 includes a mandrel 12 and a debris diverter 14 operably connected to the mandrel 12. The mandrel 12 and diverter 14 are disposed in a housing 16 that may form a part of a string 18. The mandrel 12 is annularly spaced from the housing 16 such that a debris sump 20 is defined between the housing 16 and the mandrel 12. In FIG. 1, the debris diverter is illustrated in an open position wherein tools or fluid may flow through the debris diverter 14. Debris sump 20 is illustrated as fully annular but it is noted that it may be configured as part annular as well. A length of the sump 20 may be adjusted as desired during a manufacturing phase of the assembly such that if a particular assembly is intended to be employed for a wellbore operation that anticipates a great volume of debris, the sump might be manufactured to be longer to accommodate that debris. Ideally, all of the debris that falls downhole from an uphole (colloquially in the relevant art, uphole is to the left and downhole is to the right in figures) location due to operations occurring while the debris diverter is closed will be diverted to the sump 20 and not find its way to a further downhole component such as an isolation valve 21.

Viewing FIGS. 1 and 2 together allows perception of a latch sleeve 22 causing positional change in the debris diverter 14. Specifically, in FIG. 1, the latch sleeve 22 is illustrated further downhole in the figure than it is in FIG. 2. It will be appreciated that the more downhole position is associated with an open debris diverter 14 while a more uphole position of sleeve 22 is associated with a closed position of debris diverter 14. Movement of the latch sleeve 22 may be effected by any of a number of actuators known to the art including but not limited to mechanical shifting tools, hydraulic shifting tools (whether multicycle or single cycle), control line, etc. For opening the debris diverter it will be appreciated from FIGS. 1 and 2 that the diverter 14 includes a number of flaps 24, each of which being pivotally mounted to the mandrel at pivots 26. The flaps 24 further include a counter tab 28 that extends from the pivot 26 in a direction away from the direction in which the flaps 24 extend such that a force placed on the tab 28 will cause the associated flap 24 to move from the closed position to the open position. Releasing the force, will allow a torsion spring (not visible) to move the flaps 24 back into the closed position. Hence a shifting of the latch sleeve 22 in the downhole direction, which causes the latch sleeve to contact the tabs 28 will correspondingly cause the flaps 24 to move to the open position and withdrawing the latch sleeve 22 to the more uphole position illustrated in FIG. 2, will allow the torsion springs to rotate the flaps 24 back to the closed position.

The flaps 24 collectively will come together to form a shape such as a conical shape, or a pyramidal shape. For cases where the shape is conical, each flap 24 will have a curved outer surface and the several flaps will come together to form a closed cone. Where the shape is pyramidal, the number of essentially flat flaps 24 will dictate whether the pyramidal shape is triangular, square, pentagonal, hexagonal, etc. Further, it is noted that in other embodiments, other debris diverter concepts are contemplated such as a domed flapper as the debris diverter 14. In each embodiment, the mandrel 12 will be kept free of debris by the debris diverter when the diverter 14 is closed and the diverter 14 will substantially direct debris coming in contact therewith to the sump 20.

In the position illustrated in FIG. 2, any debris falling from a more uphole origin will be shunted by the debris diverter 14 into the sump 20. In the embodiment illustrated, the debris is likely to be relatively evenly distributed around the sump 20. In other embodiments, the debris diverter may be configured to move all debris to a single side of the assembly by having longer flaps on one side of the diverter such that a profile more like a whipstock is presented to the debris.

Figure 3:
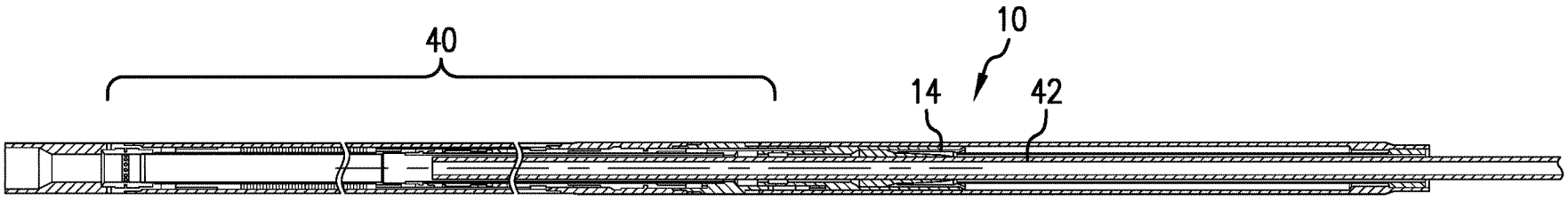
FIG. 3 is the assembly illustrated in FIG. 3 but with an actuator illustrated uphole thereof and a washpipe illustrated extending through the mandrel of the assembly.
Figure 4:
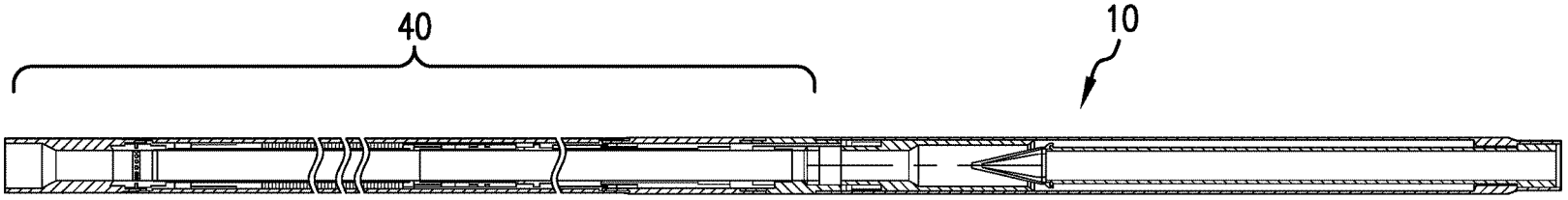
FIG. 4 is the assembly illustrated in FIG. 3 with the washpipe removed and the debris diverter closed.

Referring to FIGS. 3 and 4, the assembly is identically illustrated to that of FIGS. 1 and 2 but an actuating module 40 (spring based, hydraulic based; J-slot, Ratchet, or other counting mechanism; single shot or resettable; control line, etc.) has been disposed uphole of the assembly 10. The illustration is of a Hydraulic Module for Vault Barrier Valve which is commercially available from BHGE under product family number H48788. It is to be understood that this actuator 40 is only exemplary and that others may be substituted as noted above. Further, a washpipe 42 is illustrated extending through the open debris diverter 14 and to a more downhole location such as an isolation valve 21, for example a Vault Barrier Valve with Hydraulic Module commercially available from BHGE under Product Family H48788.nce, the washpipe has been withdrawn and the actuator 40 has allowed the debris diverter 14 to close, the illustration looks more like that of FIG. 2.

The assembly disclosed herein is beneficially disposed in a borehole system comprising a tubular string 18 having an actuator 40, and assembly 10 and an isolation valve 21.

Set forth below are some embodiments of the foregoing disclosure:

Embodiment 1

A debris management assembly including a housing, a mandrel disposed within the housing, a debris sump defined between the mandrel and the housing, and a debris diverter operably connected to the mandrel and positioned to direct debris that encounters the debris diverter into the debris sump.

Embodiment 2

The assembly as in any prior embodiment, wherein the debris sump is part annular.

Embodiment 3

The assembly as in any prior embodiment, wherein the debris sump is fully annular.

Embodiment 4

The assembly as in any prior embodiment, wherein the debris diverter is conically shaped.

Embodiment 5

The assembly as in any prior embodiment, wherein the debris diverter is triangular-pyramidally shaped.

Embodiment 6

The assembly as in any prior embodiment, wherein the debris diverter is square-pyramidally shaped.

Embodiment 7

The assembly as in any prior embodiment, wherein the debris diverter is a domed flapper.

Embodiment 8

The assembly as in any prior embodiment, wherein the debris diverter comprises a number of flaps.

Embodiment 9

The assembly as in any prior embodiment, wherein the flaps when brought together create the debris diverter.

Embodiment 10

The assembly as in any prior embodiment, wherein the flaps include a counter tab.

Embodiment 11

The assembly as in any prior embodiment, wherein the counter tab is configured to interact with an actuator.

Embodiment 12

The assembly as in any prior embodiment, wherein the debris diverter includes a flap pivotally connected to the mandrel at a pivot and further comprises a counter tab extending in a direction from the pivot opposite a direction of extension of the flap.

Embodiment 13

A borehole system including a tubular string, an actuator disposed in the tubular string, an assembly as in any prior embodiment, and an isolation valve.

Embodiment 14

The borehole system as in any prior embodiment, wherein the actuator is a sleeve.

Embodiment 15

The borehole system as in any prior embodiment, wherein the sleeve is interactive with a counter tab of the debris diverter to open the debris diverter.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A debris management assembly comprising:

a housing;

a mandrel disposed within the housing;

a debris sump defined between the mandrel and the housing; and a debris diverter operably connected to the mandrel and positioned to direct debris that encounters the debris diverter into the debris sump, wherein the debris diverter includes a flap pivotally connected to the mandrel at a pivot and further comprises a counter tab extending in a direction from the pivot opposite a direction of extension of the flap.

2. The assembly as claimed in claim 1 wherein the debris sump is part annular.

3. The assembly as claimed in claim 1 wherein the debris sump is fully annular.

4. The assembly as claimed in claim 1 wherein the debris diverter is conically shaped.

5. The assembly as claimed in claim 1 wherein the debris diverter is triangular-pyramidally shaped.

6. The assembly as claimed in claim 1 wherein the debris diverter is square-pyramidally shaped.

7. The assembly as claimed in claim 1 wherein the flap is domed.

8. The assembly as claimed in claim 1 wherein the flap comprises a number of flaps.

9. The assembly as claimed in claim 8 wherein the flaps when brought together create the debris diverter.

10. The assembly as claimed in claim 8 wherein each of the flaps include a counter tab.

11. The assembly as claimed in claim 1 wherein the counter tab is configured to interact with an actuator.

12. A borehole system comprising:

a tubular string;

an actuator disposed in the tubular string;

an assembly as claimed in claim 1, disposed in the tubular string the assembly being in operable communication with the actuator; and an isolation valve disposed in the tubular string.

13. The borehole system as claimed in claim 12 wherein the actuator is a sleeve.

14. The borehole system as claimed in claim 13 wherein the sleeve is interactive with the counter tab of the debris diverter to open the debris diverter.

* * * * *